United States Patent [19]

Tillmann

[11] 4,067,084

[45] Jan. 10, 1978

[54] AUTOMATIC DOOR CLOSER

[75] Inventor: Horst Tillmann, Ennepetal, Germany

[73] Assignee: Dorma-Baubeschlag G.m.b.H. & Co. K. G., Ennepetal-Voerde, Germany

[21] Appl. No.: 772,969

[22] Filed: Feb. 28, 1977

[30] Foreign Application Priority Data

Mar. 3, 1976 Germany ..... 2608671

[51] Int. Cl.[2] ..... E05F 1/08

[52] U.S. Cl. ..... 16/80; 16/51; 16/82; 16/84

[58] Field of Search ..... 16/51, 56, 59, 60, 61, 16/66, 70, 79, 80, 78, 82, 84; 292/341.2; 188/297

[56] References Cited

U.S. PATENT DOCUMENTS

| | | | |
|---|---|---|---|
| 2,899,702 | 8/1959 | Voster et al. | 16/66 |
| 3,273,196 | 9/1966 | Voster et al. | 16/82 |
| 3,561,036 | 2/1971 | Crane | 16/82 X |
| 3,584,331 | 6/1971 | Hooge | 16/82 |
| 3,618,160 | 11/1971 | Ellis | 16/51 X |
| 3,760,455 | 9/1973 | Berry et al. | 16/51 X |
| 3,818,637 | 6/1974 | Vivier | 16/82 X |

FOREIGN PATENT DOCUMENTS

| | | | |
|---|---|---|---|
| 408,782 | 4/1934 | United Kingdom | 16/60 |
| 1,344,945 | 1/1974 | United Kingdom | 16/51 |

*Primary Examiner*—Ronald Feldbaum
*Attorney, Agent, or Firm*—Michael J. Striker

[57] ABSTRACT

An automatic door closer includes a closer shaft to which the door to be closed is connected for turning movement therewith about the axis thereof, and spring means biasing said closure shaft to a position in which the door is closed. The door closer includes further means for releasably holding the closer shaft and the door connected thereto in any adjusted position when the door is opened beyond a predetermined angle.

12 Claims, 2 Drawing Figures

AUTOMATIC DOOR CLOSER

BACKGROUND OF THE INVENTION

The present invention relates to an automatic door closer which includes a closer shaft, projecting from a housing, to which the door to be closed is connected for turning movement therewith, and which is biased by spring means to a position in which the door is closed. The door closer includes further a link member connected to the closer shaft so as to change its position in accordance with the turning of the latter, onto which a support member acts, which can be held in an active position to thereby counteract the turning moment imparted to the closer shaft by the spring means, and which can electromagnetically released to an inactive position so that the closer shaft may turn under the influence of the spring means again to the close position. In automatic door closers of the aforementioned kind, the support member, cooperating with the link, holds thus the door in open position against the force of the spring means tending to move the door to the closed position. An automatic door closer of the aforementioned kind is known by the German Gebrauchsmuster No. 7,403,756. The link member in this known construction is constructed by an annular flange which can be clamped onto the closure shaft, which flange is provided at its outer periphery with a plurality of circumferentially spaced cutouts in which the support members can respectively engage. The support member is electromagnetically held in the engaged position in order to hold the door in selected open positions. The member may move out of the respective cutouts when the electromagnet is deenergized so that the door may move to the closed position under the influence of the turning moment imparted to the closer shaft. It is also known in such constructions to spring-bias the support member into a respective cutout aligned therewith, but all these arrangements have the disadvantage that the door can be held open only in a plurality of turned positions angularly spaced from each other and, of course, these positions have to be selected in such a manner that the support member will move, under the influence of the spring means connected thereto, into the respective cutout, which will require a careful and slow movement of the door to one of the selected positions in which the door should be held open.

The German Offenlegungsschrift No. 2,201,594 discloses further an automatic door closer in which damping means, including cylinder and piston means for limiting the speed at which the door can be closed, are provided with an electromagnetically operable valve which in its closed position prevents fluid from flowing out from the working compartment of the cylinder and piston means to this stop the closing movement of the door until the electromagnet is deenergized so that the valve will move to its open position.

From the German Offenlegungsschrift No. 2,311,343 it is further known to connect to the movable element of damping means, limiting the speed of turning of the door and constructed as cylinder and piston means, an additional cylinder and piston arrangement which, in turn, by means of a valve, which can be electromagnetically held in a closed position, permits to maintain the door of an automatic door closer in any desired open position until the electromagnet is deenergized.

Automatic door closers of the aforementioned kind, which include damping means and electromagnetically operated control means connected thereto, are, however, expensive to manufacture and require a relatively large space.

SUMMARY OF THE INVENTION

It is an object of the present invention to provide an automatic door closer in which the door may be held in any selected open position, at least after turning the door through a predetermined angle from the closed position, and which avoids the disadvantages of such door closers known in the art.

It is a further object of the present invention to provide an automatic door closer of the aforementioned kind which can be manufactured at a reasonable cost and which will stand up porperly under extended use.

With these and other objects in view, which will become apparent as the description proceeds, the automatic door closer according to the present invention mainly comprises housing means, a closer shaft adapted to be connected to the door to be closed, said shaft being mounted with an end portion in the housing means turnably about its axis between a first position in which the door is closed and a plurality of second positions in which the door is turned through different angles from the closed position, means for biasing the closer shaft to the first position and comprising spring means and link means including a first link connected to said closure shaft so as to change its position upon turning of the latter, in which the first link means has a first convexly curved cam face rising in direction of its movement, follower means arranged to engage the cam face when the door is turned through a predetermined angle from the closed position and in which the cam face is constructed to displace the follower means to an increasing extent to a plurality of adjusted positions when the door is turned in opening direction beyond the predetermined angle, and releasable means for holding the follower means in any of the adjusted positions and therewith the closer shaft in a position in which the door connected thereto held in an open position.

The rising cam curve, which extends over a length corresponding to the door opening angle in which the door has to be blocked, thus replaces the locking cutouts, which are for instance provided in a ring flange fixed to the closer shaft. The cam curve rising in the direction of movement can for instance be in a turnable first link in the form of a flat spiral so that the follower means will provide in each position thereof a holding component which compensates the force of spring means biasing the closer shaft to the first position, that is, the door may be held in any turned position in a region determined by the length of the cam face until the follower means is released. Corresponding to the rise of the cam face, the follower means must be held in any of its adjusted positions which can be easily accomplished by electromagnetically controlled releasing means.

In automatic door closers of the aforementioned kind, it is often desired that the door, when turned through a small angle in opening direction from the closed position, will not be held in any such slightly turned position, but will be automatically turned to the closed position when released. In such case the first link may comprise a second, concavely curved cam face arranged to be engaged by the follower means in the closed position of the door and when the door is turned from the closed position through an angle less than the abovementioned predetermined angle, and in which the second cam face is constructed so as not to displace the follower means during turning of the door from the closed position up to the predetermined angle.

The electromagnetic arresting of the follower means in any adjusted position can be carried out in an especially simple manner if, in accordance with a further feature of the present invention, cylinder and piston means are connected as a hydraulic linkage between the releasable holding means and the follower means. In such a construction it is possible to hold the electromagnetically introduced forces relatively small without detrimentally influencing the operation accuracy of the arrangement. In such an arrangement it is advantageous to construct the follower means as an elongated member carrying at one end a roller in engagement with a respective one of the cam faces and means for guiding the elongated members for movement in the longitudinal direction thereof and in which a two-armed lever is arranged between the other end of the elongated member and the piston of the cylinder and piston unit. It is, however, also possible to construct the follower means as a tiltable element in which case a transmission member between the piston of the cylinder and piston unit and the follower means can be eliminated.

The means for guiding the elongated member may comprise a bushing and the housing means may comprise a housing filled with hydraulic fluid in which the cylinder and piston means, the releasable holding means and the two-armed lever are located and in which the housing means is provided in a wall thereof with an opening through which the bushing may be inserted in a fluid-tight manner, with a portion of the elongated member extending into the aforementioned housing. Such an arrangement simplifies assembly, as well as proper maintenance of the construction.

As already mentioned, the cam face may be provided on a selected link connected to the closer shaft. For instance it could be provided on a longitudinally movable link. In a preferred arrangement the first link is pivotally connected to the closer shaft by a pin eccentrically arranged with respect to the axis of the closer shaft and the first link is also connected to a lever pivotally connected at one end thereof to the housing means and at the other end to one end of the spring biasing the closer shaft to the first position, in which the door connected thereto is closed. The aforementioned first link has therefore in this construction a double function.

The electromagnet means preferably comprise an armature for moving a valve member controlling flow of fluid out of the cylinder and piston means, and a magnet winding surrounding the armature, in which the magnet winding is, adjustable in axial direction of the valve member, connected to the cylinder of the cylinder and piston means so that the electromagnetic force produced by the electromagnet means may be adjusted in correspondence with the necessary force for holding the follower means in any adjusted position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
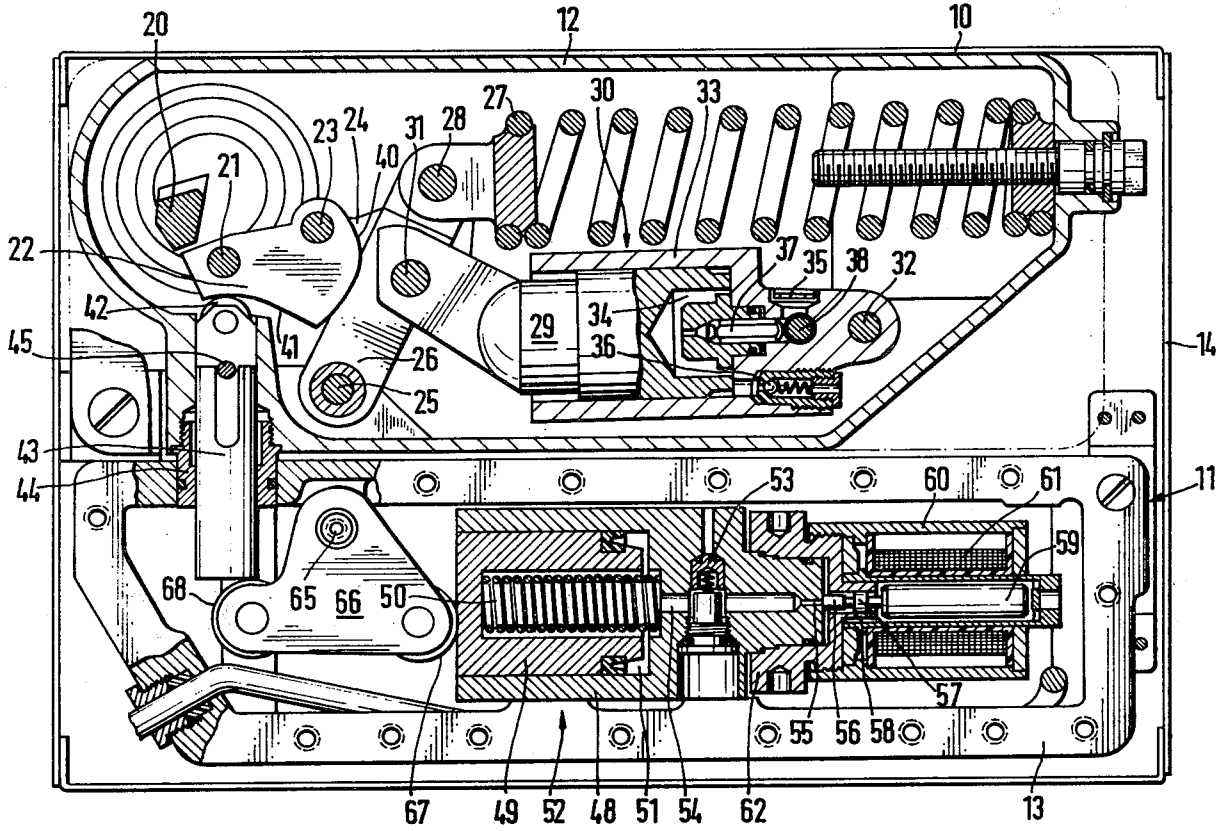
FIG. 1 is a partially sectioned top view of the door closer in accordance with the present invention, showing the various elements thereof in a position in which the door connected thereto is closed.

The automatic door closer according to the present invention comprises two units, that is, a door closer unit 10 and a door open holding arrangement 11, which are respectively located in a housing 12, respectively 13. Both housings are arranged in a common so-called cementing box 14, which is located beneath the bottom edge of the door, not shown in the drawing, to which the automatic door closer is connected. The housings 12 and 13 are both filled with a hydraulic fluid and they are closed tightly by covers, not shown in the drawing.

A closer shaft 20 to which a door, not shown in the drawing, is connected for turning movement therewith, is mounted with a lower end portion thereof in the housing 12 for turning movement about its axis. Link means, including a first link 22, are connected by a pin 21, eccentrically arranged with respect to the axis of the closure shaft, to the latter and the link means include a second link 24 pivotally connected to the first link 22 by a pin 23 and the second link, in turn, is connected to a lever 26 pivotally mounted at one end on a pivot pin 25 fixed to the housing 12. The other end of the lever 26 is connected by a connecting pin 28 to a pretensioned tension coil spring 27, the tension of which is adjustable, and which is thus connected to the closer shaft 20 to apply a turning movement thereto in a direction to bias the closure shaft to a first position, in which the door connected thereto is closed. Cylinder and piston means 30 located in the housing 12, substantially parallel to the tension coil spring 27, are connected by a pin 31 to the lever 26, intermediate the pins 25 and 28. The cylinder and piston means 30 comprise a cylinder 33 tiltably mounted at one end by a pin 32 in the housing 12, and a piston 29 axially movable in the cylinder and forming therewith a working space 34, into which fluid contained in the housing 12 will be sucked through a non-illustrated check valve, when the piston 29 moves towards the left, as viewed in FIG. 1, during movement of the closer shaft 20 in door opening direction. The cylinder and piston means 30 is further provided with an overpressure valve 36, which communicates with the working space 34, and an adjustable throttle valve 37 through which fluid is discharged from the working space 34 through the channel 35 into the interior of the housing 12, during movement of the piston 29 toward the right, as viewed in FIG. 1, i.e., during movement of the closer shaft 20 in door closing direction, so that the speed of the closing movement of the door will be controlled by the cylinder and piston means 30, depending on the adjustment of the throttle valve 37. If an outer force acts on the open door in door closing direction, the overpressure valve 36 can open, in order to limit the pressure in the working space 34 to a predetermined pressure. The door closer as described up to now is known in the art.

Figure 2:
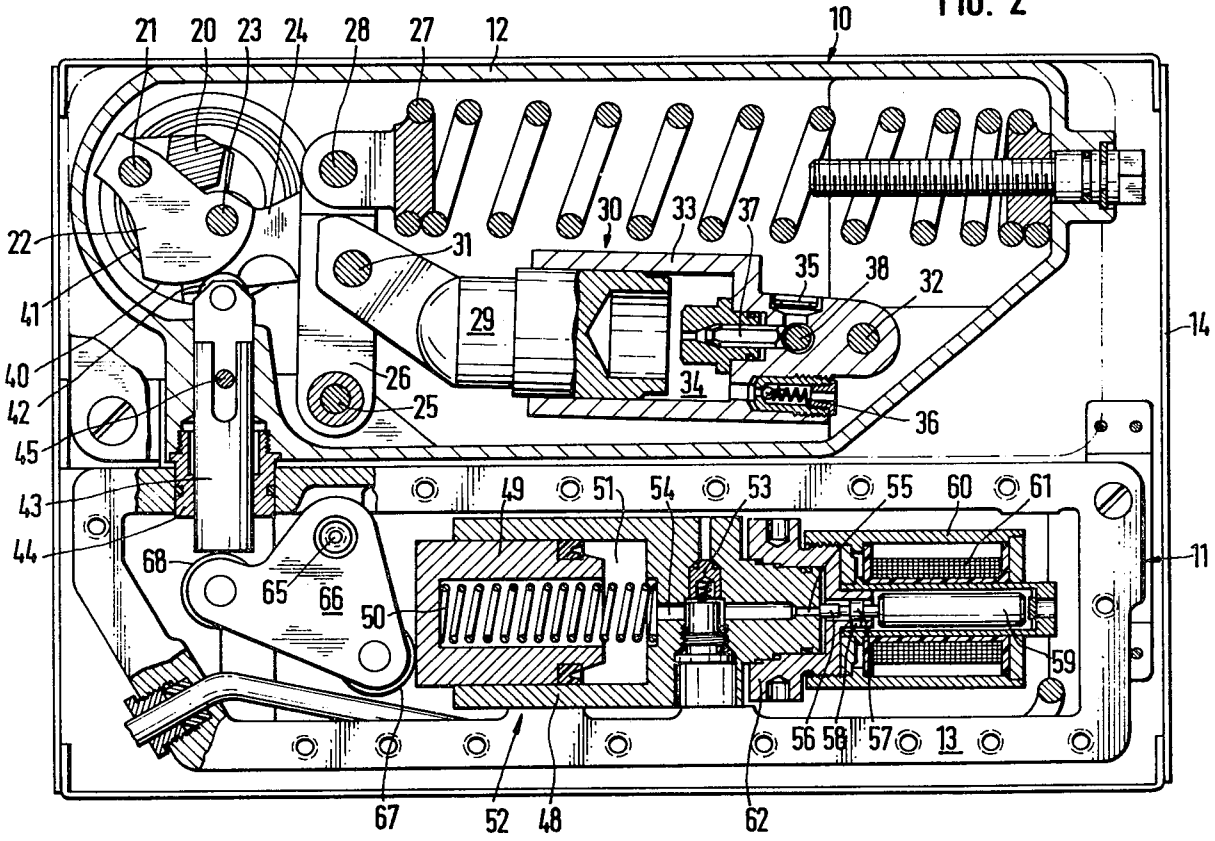
FIG. 2 is a partially sectioned top view similar to FIG. 1, in which the various elements of the door closer are shown in a position in which the door connected to the door closer is turned in opening direction through an angle of 120 degrees from the closed position.

In accordance with the present invention, the first link 22, the position of which evidently changes during turning of the closer shaft 20, has a first convexly curved cam face 40 which gradually rises in the direction of movement of the first link 22 during movement of the closer shaft 20 in door opening direction. The first convexly curved cam face 40 is followed by a cutout 41, forming a concavely curved second cam face. Cam follower means cooperate with the cam faces 40 and 41. These cam follower means preferably comprise an elongated support member 43 mounted in a bushing 44 for movement in longitudinal direction thereof and prevented from turning by a pin 45 engaging into an elongated slot formed in the member 43. The member 43 carries at one end thereof a roller 42, which engages the cam face 40, when the door is turned in opening direction beyond a predetermined angle from the closed position, as shown in FIG. 2, and the cam face 40 is constructed to displace the cam follower means 42, 43 to an increasing extent to a plurality of adjusted positions when the door is turned in opening direction beyond the aforementioned predetermined angle. When the door is closed, as well as when the door is turned from the door closing position through an angle less than the predetermined angle, the rollers 42 will engage the second cam face 41, as shown in FIG. 1, and this second cam face is constructed so as to not displace the cam follower means during turning of the door from the closed position up to the aforementioned predetermined angle.

The automatic door closer according to the present invention is further provided with releasable means for holding the cam follower means 42, 43 in any of the adjusted positions and therewith the closer shaft 20 in a position in which the door connected thereto is held in a selected open position.

These releasable means comprise piston and cylinder means 52 having a cylinder 48 fixedly mounted in the housing 13 into which a piston 49 is movable against the force of a compression coil spring 50. A check valve 53 communicating with the working space 51 of the cylinder and piston means 52 will open when the piston 49 moves under the force of the compression spring 52 towards the left, as viewed in FIG. 1, so that liquid from the interior of the housing 13 will enter into the working space 51. Such liquid will flow into the working space 51 through a bore 54 formed in the bottom of the cylinder 48. The bore 54 is continued by a coaxial bore 55, of smaller diameter than the bore 54, and a valve member 56 can be pressed against the outer or right end of the small bore 55. The valve member 56 is provided with an annular collar 57 having a diameter greater than that of the bore 55, which closes, in the position of the valve member 56 as shown in FIG. 1, a channel 58. The armature 59 of an electromagnet acts on the end of the valve member 56, which faces away from the bore 55, and the armature 59 is axially movable in the electromagnet winding 61, which in turn is mounted in a casing 60. The casing 60 is connected by a threaded connection 62 to the bottom region of the cylinder 48, so as to be adjustable in axial direction with respect to the cylinder 48. Liquid can flow from the working space 51 of the cylinder and piston unit 52 through the bores 54, 55, if the valve member 56 is displaced towards the right, as viewed in FIG. 1, and the collar 57 opens the channel 58.

The outer end face of the piston 49 is engaged by a roller 67 mounted on one end of two-armed lever 66 mounted for pivotal movement on a pivot pin 65 in the housing 13, whereas a second roller 68 on the other end of the two-armed lever 66 engages the lower end of the elongated support member 43, so that the roller 42 carried by the other end of the member 43 will be held in engagement with the respective cam face 40 or 41.

In the closed position of the door, which is illustrated in FIG. 1, the piston 49 is moved against the tension of the spring 50 farthest into the cylinder 48. The electromagnet 59, 60, 61 may thereby be energized or de-energized. For the description of the operation of the automatic door closer according to the present invention, it is now assumed that the electromagnet 59 – 61 is energized so that the valve member 56 abuts in a sealing manner against the outer end of the bore 55. During opening of the door, i.e., during turning of the closer shaft 20 in clockwise direction, the position of the various elements of the door holding means 11 will not be changed while the roller 42 passes over the concave cam face 41 of the link 22. During this part of the movement of the closer shaft 20, the coil tension spring 27 will be further tensioned, while the damping piston 29 will be moved towards the left, as viewed in FIG. 1 so that its working space 34 will increase. If the door, after turning through a relatively small predetermined angle from its closed position, is released, while the roller 42 is still engaged with the concave cam face 41, the door will automatically close under the action of the spring 27 since the holding arrangement can act only when the convex cam face 40 is engaged by the roller 42. If the door is turned in opening direction through a larger angle than the abovementioned predetermined angle so that the roller 42 will engage the convexly curved cam face 40, then the member 43 will be displaced to an increasing extent so that the piston 49 will be moved under the action of the spring 50 correspondingly out of the cylinder 48, increasing thereby the working space 51 of the cylinder and piston unit 52 so that liquid from the interior of the housing 13 will pass through the check valve 53 into the working space 51. If now, the door is released while the electromagnet 59, 60, 61 is energized to hold the valve member 56 in its closed position, the member 43 evidently cannot be displaced from its adjusted position, since liquid cannot be discharged from the working space 51 when the bore 55 is closed. The member 43 will therefore be held in any adjusted position by the lever 66 and the door is prevented from turning in counterclockwise direction to the closed position. Only after the electromagnet 59 – 61 is de-energized, so that the valve member 56 can open, liquid can be discharged from the working space 51 of the cylinder and piston means 52 so that the door will move in closing direction under the influence of the force imparted by the tensioned spring 27 thereto. For simplification reasons the means for engerizing and de-energizing the electromagnet 59 – 61 are not shown in the drawing, but such means are evidently well known in the art.

If, while the electromagnet 59 – 61 is energized, a strong force acts in closing direction on the door, while the latter is held in open position, the fluid pressure in the working space 51 of the cylinder and piston unit 52 can increase in such a manner that it will displace the valve member 56, against the force of the electromagnet 59 – 61, from its closed position, and the increased fluid pressure will act on the enlarged face of the collar 57 to positively displace the valve member 56 to its open position, whereby the door holding means will become inactive. Usually, the door will thereby be moved to its closed position even if the outer force will act only a short time thereon since the fluid pressure will act now on the face defined by the outer diameter of the collar 57. The body 60, 61 of the magnet can be adjusted so that the force produced on the armature 59 can be correspondingly adjusted in such a manner that the door may be securely held in an adjusted open position, but that the door may be closed upon action of a sufficiently large outer, in closing direction acting, force.

It will be understood that each of the elements described above, or two or more together, may also find a useful application in other types of automatic door closer, differing from the types described above.

While the invention has been illustrated and described as embodied in an automatic door closer in which the door may be held open in any selected position when the door is turned through a predetermined angle beyond the closed position, it is not intended to be limited to the details shown, since various modifications and structural changes may be made without departing in any way from the spirit of the present invention.

For instance, instead of connecting the first link by a crank pin to the closer shaft, it would also be possible to provide a flange connected to the closer shaft with a cam increasing in steepness when the closer shaft is turned in open direction and it would also be possible to provide such cam on a link member movable in a straight line during turning of the closer shaft.

Without further analysis, the foregoing will so fully reveal the gist of the present invention that others can, by applying current knowledge, readily adapt it for various applications without omitting features that, from the standpoint of prior art, fairly constitute essential characteristic of the generic or specific aspects of this invention.

What is claimed as new and desired to be protected by Letters Patent is set forth in the appended claims.

1. An automatic door closer comprising housing means; a closer shaft adapted to be connected to a door to be closed, said shaft being mounted with an end portion thereof in said housing means turnable about its axis between a first position in which the door is closed and a plurality of second positions in which the door is turned through different angles from the closed position; means in said housing means for biasing said closer shaft to said first position and comprising spring means and link means including a first link connected to said closer shaft so as to change its position upon turning of the latter, said first link having a first convexly curved cam face rising in direction of the movement of the door away from said closed position; follower means arranged to engage said cam face when the door is turned beyond a predetermined angle from the closed position and said cam face being constructed to displace said follower means to an increasing extent to a plurality of adjusted positions when the door is turned in opening direction beyond said predetermined angle; and releasable means for holding said follower means in any of said adjusted positions and therewith said closer shaft in a position in which the door connected thereto is held in a selected open position.

2. An automatic door closer as defined in claim 1, and including electromagnet means for controlling said releasable holding means.

3. An automatic door closer as defined in claim 1, wherein said first link comprises a second concavely curved cam face arranged to be engaged by said follower means in said closed position of said door and when the door is turned from said closed position through an angle less than said predetermined angle, said second cam face being constructed so as not to displace said follower means during turning of the door from the closed position up to said predetermined angle.

4. An automatic door closer as defined in claim 1, and including cylinder and piston means connected as a hydraulic linkage between said releasable holding means and said follower means.

5. An automatic door closer as defined in claim 4, wherein said cylinder and piston means comprises a stationary cylinder, a spring loaded piston operatively connected to said follower means to be axially displaced out of said piston corresponding to the increasing displacement of said follower means and sucking thereby fluid into said cylinder, and wherein said releasable holding means comprises a valve member movable between a closed position preventing discharge of fluid from said cylinder so as to hold said piston and the follower means operatively connected thereto in any displaced position, and an open position permitting discharge of fluid from said cylinder, and electromagnet means connected to said valve member for moving the same between said positions thereof.

6. An automatic door closer as defined in claim 5, wherein said follower means comprises an elongated support member carrying at one end a roller in engagement with a respective one of said cam faces, and means for guiding said elongated member for movement in the longitudinal direction thereof.

7. An automatic door closer as defined in claim 6, and including a two-armed lever between the other end of said elongated member and said piston of said cylinder and piston means.

8. An automatic door closer as defined in claim 7, wherein said means for guiding said elongated member comprises a bushing, and wherein said housing means comprises a housing filled with a hydraulic fluid in which said cylinder and piston means, said releasable holding means and said two-armed lever are located, said housing being provided in a wall thereof with an opening through which said bushing can be inserted in a fluid tight manner with a portion of said elongated member extending into said housing.

9. An automatic door closer as defined in claim 1, wherein said biasing means comprises a tension spring, and wherein said link means comprises a pin eccentrically arranged with respect to the axis of the closer shaft for pivotally connecting said first link in the region of one end thereof to said closer shaft, a lever pivotally connected at one end thereof to said housing means and at other end thereof to one end of said tension spring and a further link between said lever and said first link.

10. An automatic door closer as defined in claim 9, and including damping means connected to said lever.

11. An automatic door closer as defined in claim 5, wherein said electromagnet means comprises an armature connected to said valve member and a magnet winding in which said armature is movable in axial direction, and means connecting said magnet winding to said cylinder adjustable in the axial direction of said winding relative to said valve member.

12. An automatic door closer as defined in claim 8, wherein said cylinder includes a passage providing communication between the interior of said cylinder and said fluid filled housing, and including a one-way valve in said passage.

* * * * *